US007707919B1

(12) United States Patent
Moellering

(10) Patent No.: US 7,707,919 B1
(45) Date of Patent: May 4, 2010

(54) ONE-PIECE STRIPPER RETAINER FOR A PUNCH

(75) Inventor: David J. Moellering, Orchard Lake, MI (US)

(73) Assignee: Moeller Manufacturing Company, Inc., Plymouth, MI (US)

( * ) Notice: Subject to any disclaimer, the term of this patent is extended or adjusted under 35 U.S.C. 154(b) by 406 days.

(21) Appl. No.: 11/385,552

(22) Filed: Mar. 21, 2006

Related U.S. Application Data

(60) Provisional application No. 60/663,695, filed on Mar. 21, 2005.

(51) Int. Cl.
*B21D 45/06* (2006.01)
*B26F 1/14* (2006.01)

(52) U.S. Cl. ..... 83/111; 83/139; 83/146

(58) Field of Classification Search ..... 285/124.3, 285/325; 83/111, 129, 136, 138–143, 145, 83/146, 698.91; 279/79
See application file for complete search history.

(56) References Cited

U.S. PATENT DOCUMENTS

| | | | | | |
|---|---|---|---|---|---|
| 1,592,093 | A | * | 7/1926 | Foucault | 285/325 |
| 1,866,905 | A | * | 7/1932 | Prompt | 285/79 |
| 2,230,043 | A | * | 1/1941 | Moran | 83/138 |
| 2,956,379 | A | * | 10/1960 | Statler | 451/351 |
| 3,211,035 | A | * | 10/1965 | Whistler et al. | 83/139 |
| 3,234,835 | A | * | 2/1966 | Archbold et al. | 83/139 |
| 3,269,238 | A | * | 8/1966 | Whistler et al. | 83/139 |
| 3,485,122 | A | * | 12/1969 | Achler et al. | 83/139 |
| 3,871,254 | A | * | 3/1975 | Whistler et al. | 83/139 |
| RE29,247 | E | * | 6/1977 | Kilstrom et al. | 15/380 |
| 4,048,889 | A | * | 9/1977 | Finley | 83/138 |
| 4,215,608 | A | * | 8/1980 | Herlan | 83/139 |
| 4,428,262 | A | * | 1/1984 | Vlahek | 83/139 |
| 5,138,919 | A | * | 8/1992 | Wilhelm | 83/139 |
| 5,359,914 | A | * | 11/1994 | Brown | 83/139 |
| 5,839,183 | A | * | 11/1998 | Powlett | 29/464 |
| 6,651,851 | B2 | * | 11/2003 | Muderlak et al. | 222/333 |
| 6,743,086 | B2 | * | 6/2004 | Nelson et al. | 451/527 |
| 2006/0071062 | A1 | * | 4/2006 | Weigelt | 234/53 |

* cited by examiner

*Primary Examiner*—Clark F. Dexter
(74) *Attorney, Agent, or Firm*—Gifford, Krass, Sprinkle, Anderson & Citkowski, P.C.

(57) ABSTRACT

A one-piece stripper retainer for plastic cup shaped strippers with a universal snap-in design that can be used with both older style and newer style punch retainers. The stripper retainer incorporates an anti-rotation heel with a snug fit around a portion of the punch retainer body and clamps to the punch itself. In a second version, the stripper retainer also clamps to the punch itself but lacks the heel. In a third version, the stripper retainer bolts to the punch retainer with a separate threaded screw. In all three versions, the plastic stripper is locked in place by the snap-in feature without any additional clamping force.

8 Claims, 4 Drawing Sheets

ONE-PIECE STRIPPER RETAINER FOR A PUNCH

This application claims the benefit of provisional patent application No. 60/663,695 filed Mar. 21, 2005.

BACKGROUND OF THE INVENTION

The field of the invention pertains to punches and dies for forming holes and depressions in metals. In particular, the invention pertains to devices and accessories for preventing work pieces from adhering to punches during high-speed high production manufacturing.

Examples of modern punch retainers are shown in applicant's previous U.S. Pat. Nos. 5,357,835, 5,410,932 and Des. 351,395. Views of these punch retainers are also shown in FIGS. 1, 2, 8 and 9. Modern punches for certain applications utilize a polyurethane cup that fits over the punch and is attached to the punch retainer by a two-piece metal stripper retainer. The two-piece stripper retainer was developed to provide adequate axial support for the cup. Although inexpensively stamped from sheet steel, the two-piece stripper retainer does not rigidly and accurately retain the polyurethane cup to the punch retainer to the degree desired. In addition, the two-piece stripper retainer will not fit the industries' new smaller footprint ball-lock punch retainer for round shaped punches.

SUMMARY OF THE INVENTION

The new one-piece stripper retainer is a replacement for the older style two-piece stamped stripper retainer. The new style incorporates a unique snap-in design and can be used with both older style and newer style punch retainers. The new unit, being machined rather than stamped, is more precise and more accurately retains the urethane stripper, promoting improved life. The one-piece design simplifies the use of this stripper retainer by eliminating pieces that can get lost and provides for easier assembly by consolidating parts. In use, the urethane strippers grow or mushroom larger at their working end. Because the stripper has a head on one end and is deformed larger at the opposite end, the stripper is trapped. This makes it difficult or impossible to remove. Normal practice requires that the urethane stripper be cut in half or the stripper and retainer are thrown away. The new style eliminates this problem because exiting the retainer is accomplished by moving the urethane sideways out of the retainer, thus missing the interference caused by the mushroomed working end. The snap-in feature eliminates the need for any additional clamping force. The new stripper retainer in the first version incorporates an anti-rotation heel and snug fit around a portion of the punch retainer body that retains the punch and clamps to the punch itself. In a second version, the new stripper retainer also clamps to the punch itself but lacks the heel, and in a third version bolts to the punch retainer itself.

DESCRIPTION OF THE PREFERRED EMBODIMENTS

Figure 1:
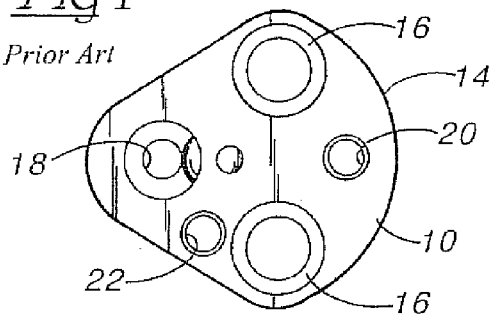
FIG 1 Prior Art
FIG. 1 is a top plan view of a prior art punch retainer.
Figure 2:
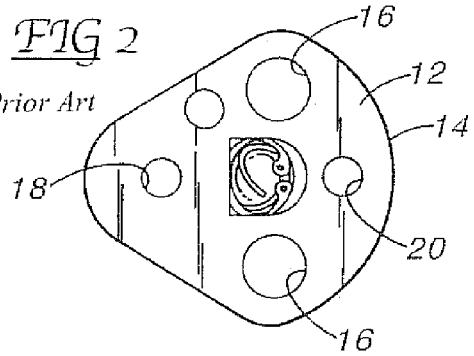
FIG 2 Prior Art
FIG. 2 is a bottom plan view of the prior art punch retainer of FIG. 1.
Figure 3:
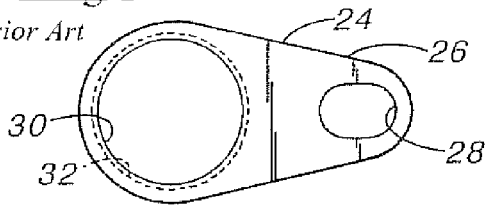
FIG 3 Prior Art
FIG. 3 is a top plan view of the upper piece of a prior art two-piece stripper retainer.
Figure 4:
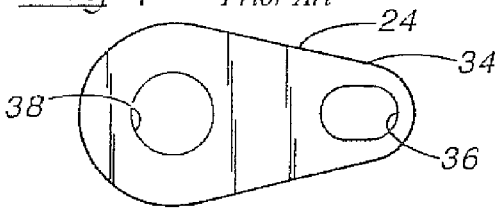
FIG 4 Prior Art
FIG. 4 is a top plan view of the lower piece of a prior art two-piece stripper retainer.

Illustrated in FIGS. 1 and 2 is the top 10 and bottom 12 of a prior art punch retainer 14. The punch retainer 14 includes counter-bored bolt holes 16 and a ball-lock punch retention hole 18. In addition, there are threaded holes 20 and 22. The prior art two-piece stripper retainer 24 in FIGS. 3 and 4 comprises an upper piece 26 having an oblong hole 28 and a circular hole 30 that is counter-bored 32 from the underside. The lower piece 34 comprises and oblong hole 36 and a circular hole 38 sized to fit over a punch P (a portion of the punch P is shown in FIG. 6).

Figure 5:
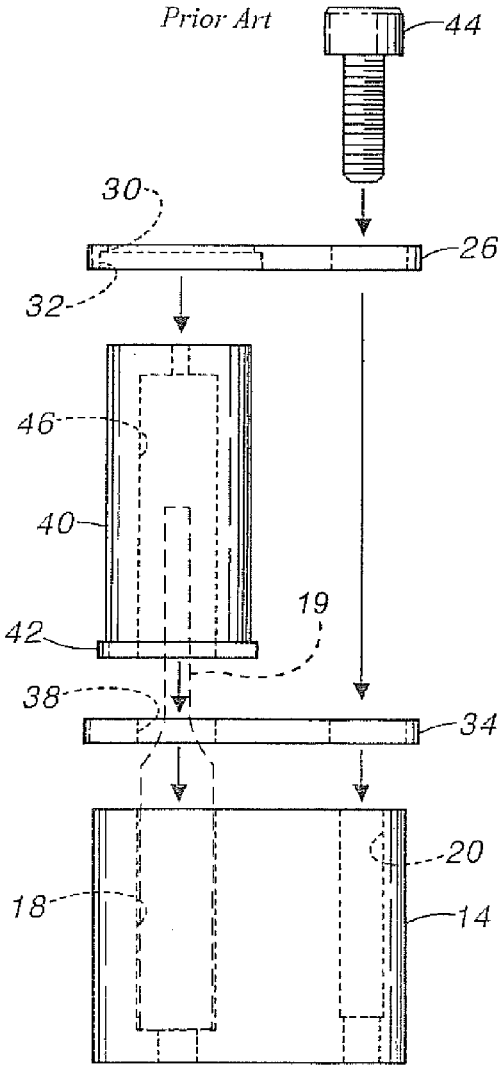
FIG 5 Prior Art
FIG. 5 is an exploded side view of a prior art stripper being attached to a retainer by a prior art two-piece stripper retainer.
Figure 6:
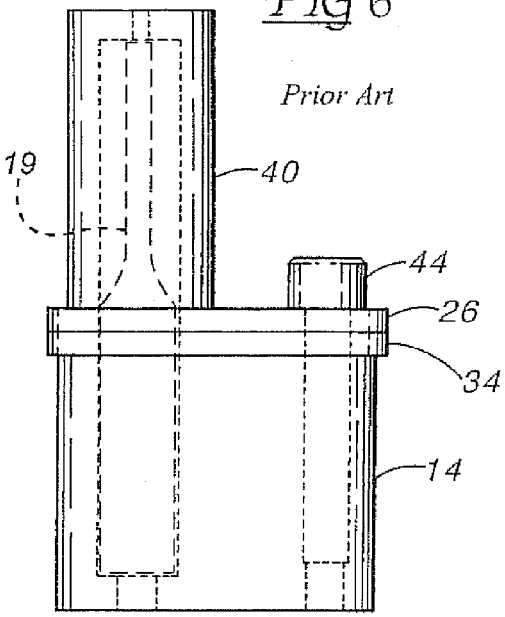
FIG 6 Prior Art
FIG. 6 is the assembled side view of the prior art device of FIG. 5.
Figure 7:
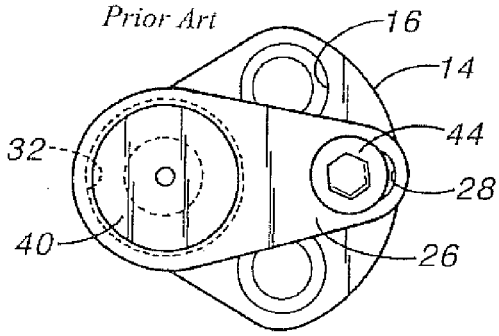
FIG 7 Prior Art
FIG. 7 is a top plan view of the prior art device of FIG. 6.

As shown in FIGS. 5, 6 and 7, the upper piece 26 and lower piece 34 are assembled to the stripper cup 40 with the cup flange 42 fitting in the counter-bore 32 and the cup extending upwardly through hole 30 of the upper piece 26. As shown in FIG. 5, the flange 42 extends outwardly from the stripper cup 40. A screw 44 passes through the oblong holes 28 and 36 and screws into threaded hole 20 in the punch retainer 14. As shown in FIG. 6, a punch 19 is retained in hole 18 and passes through hole 38 up into the stripper cup interior 46.

Figure 8:
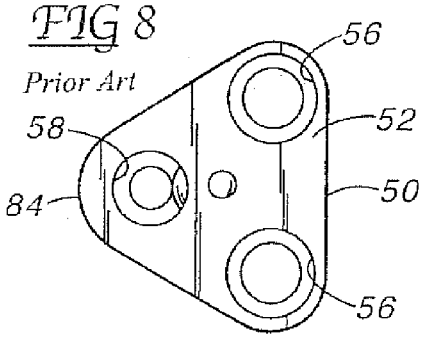
FIG 8 Prior Art
FIG. 8 is a top plan view of a prior art mini punch retainer.
Figure 9:
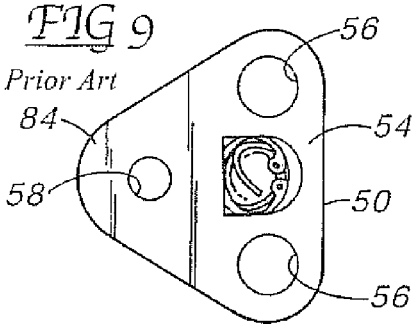
FIG 9 Prior Art
FIG. 9 is a bottom plan view of the prior art mini punch retainer of FIG. 8.

Illustrated in FIGS. 8 and 9 is a mini punch retainer 50, top 52 and bottom 54. Counter-bored bolt holes 56 and punch retention hole 58 are formed in retainer 50, however, missing are the threaded holes 20 and 22 and rounded portion about hole 20 in retainer 14 above. As a result, the two-piece stripper retainer 24 above cannot be used with the mini punch retainer 50.

Figure 10:
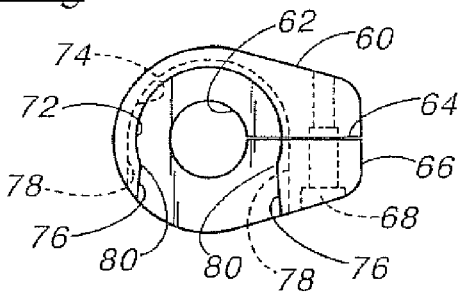
FIG. 10 is a top plan view of the first version of the new one-piece stripper retainer.
Figure 11:
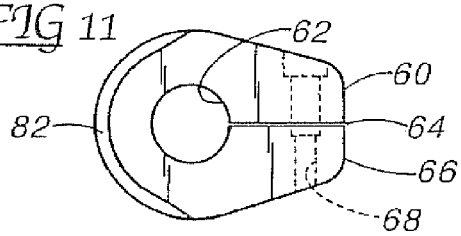
FIG. 11 is a bottom plan view of the stripper retainer of FIG. 10.
Figure 12:
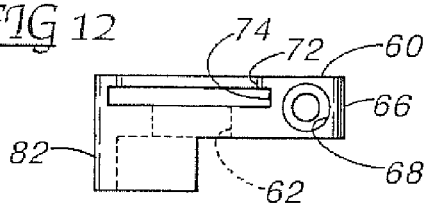
FIG. 12 is a side elevation of the stripper retainer of FIG. 10.
Figure 14:
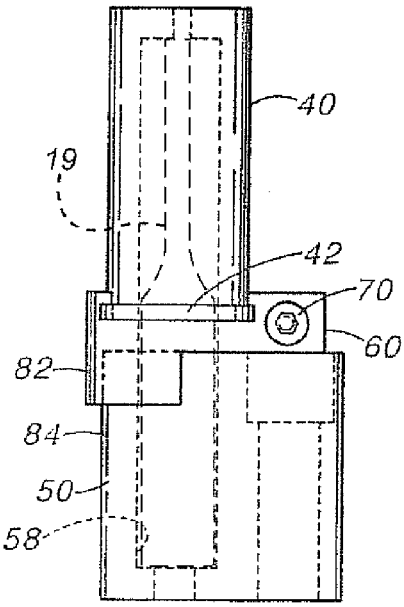
FIG. 14 is the assembled side view of FIG. 13.

Illustrated in FIGS. 10, 11 and 12 is the first new version of a one-piece stripper retainer 60. The new stripper retainer 60 has a bore hole 62 sized to just fit over a punch shaft extending from the retention hole 58 and a slot 64 extending from the bore hole to the exterior in the extended portion 66 of the retainer. The retainer 60 includes a hole that is drilled, counter-bored and threaded in the extended portion 66 for a screw 70 (shown in FIG. 14) to tighten and loosen the retainer about the punch shaft (a portion of the punch 19 is shown in FIG. 14). It is appreciated that FIGS. 10 and 11 teach slot 64 extending through the stripper retainer 60 and being generally perpendicular to the rest of the retainer. As shown, the slot 64 divides the extended portion 66 of the retainer into two portions and the screw can move them towards each other.

As best shown in FIGS. 10 and 12, bore hole 62 is counter-bored 72 to the outside diameter of the stripper cup 40 and further undercut 74 to accommodate the stripper cup flange 42. It is appreciated that the undercut 74 has a diameter greater than a diameter of the counter-bore 72. Both the counter-bore 72 and the undercut 74 are slotted open at 76 and 78 respectively in a direction parallel to the axis of the hole 68 and screw 70. The slot 78 width for the undercut 74 is at least equal to the diameter of the flange 42, however, the slot 76 for the counter-bore 72 has a neck at 80 slightly less than the diameter of the stripper cup 40. The slot 76 widens out from the neck 80 to the exterior of stripper retainer as best shown in FIG. 10. Thus, the stripper cup 40 "snaps in" and "snaps out" of the stripper retainer 60.

Figure 13:
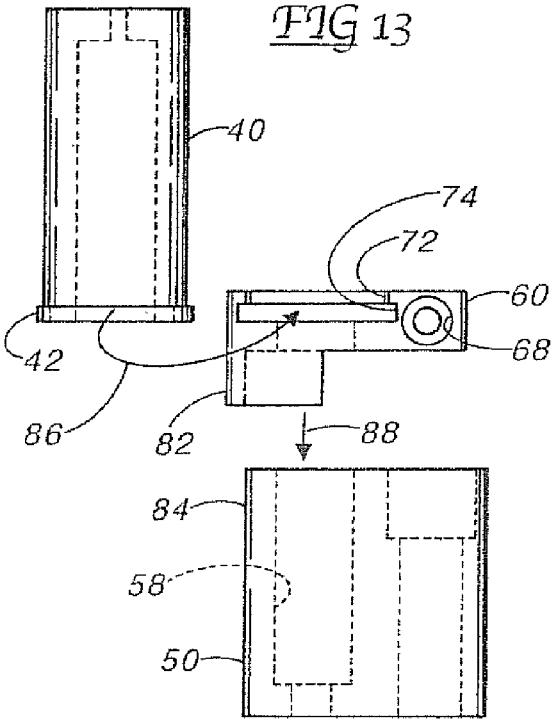
FIG. 13 is an exploded side view of a stripper being attached to a mini retainer by the new one-piece stripper retainer of FIG. 10.
Figure 15:
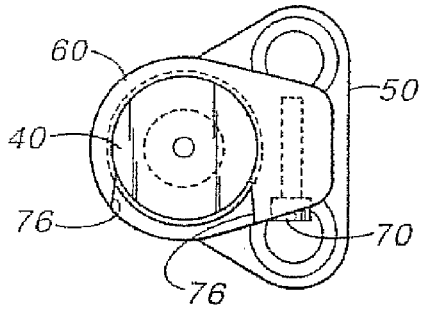
FIG. 15 is a top plan view of FIG. 14.

Stripper retainer 60 includes a descending anti-rotation heel 82 shaped to snuggly fit the nose 84 of the mini punch retainer 50 with bore hole 62 axially aligned to punch retention hole 58 as best shown in FIGS. 13, 14 and 15. As shown in FIG. 14, with the punch already in the punch retention hole 58, the stripper cup 40 is snapped into the stripper retainer 60 as indicated by arrow 86 and the stripper retainer placed on the punch retainer 50 with the punch passing through the bore hole 62 as indicated by arrow 88. It is appreciated that FIG. 12 teaches the stripper retainer 60 is a generally planar member with the bore hole 62, counter-bore 72 and undercut 74 therewithin. In addition, the anti-rotation heel 82 extends from the generally planar member.

Figure 16:
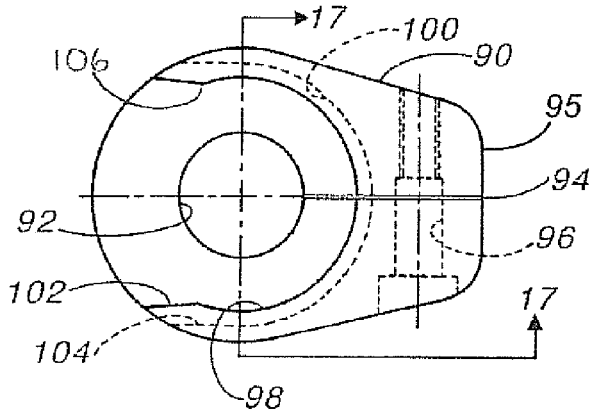
FIG. 16 is a top plan view of the second version of the new one-piece stripper retainer.
Figure 17:
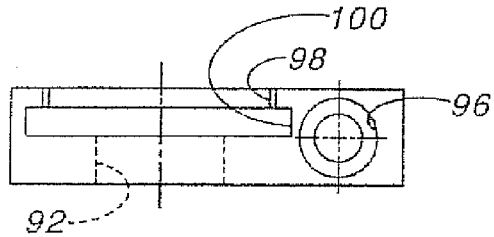
FIG. 17 is a side elevation and nose view of the one-piece stripper retainer of FIG. 16.

Illustrated in FIGS. 16 and 17 is the second version of the new one-piece stripper retainer 90. This stripper retainer 90 includes a bore hole 92, a slot 94 and an extended portion 95 that has a drilled, counter-bored and threaded hole 96 as in the first version but lacks the heel. As above, the stripper retainer 90 is counter-bored at 98 and undercut 100 about the bore hole 92, however the slotted openings for 102 and 104 for the counter-bore 98 and undercut 100 respectively are parallel and centered with the slot 94. As above, the slot 102 necks down at 106 to provide the snap-in feature for the stripper cup 40.

The second version of the new one-piece stripper retainer 90 clamps tightly to a punch extending from a punch retaining hole 58 as with the first version above. The second version 90, however, is best suited for circular punches where rotational position about the axis of the bore hole 92 and punch retaining hole 58 is not critical. The second version 90 benefits from ease of installation and economy of manufacture. In addition, it is appreciated that FIG. 17 teaches the stripper retainer 90 is a generally planar member with the bore hole 92, counter-bore 98 and undercut 100 therewithin.

Figure 18:
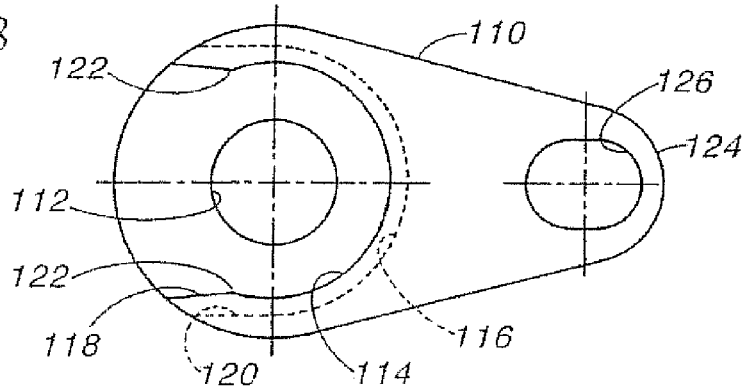
FIG. 18 is a top plan view of the third version of the new one-piece stripper retainer.
Figure 19:
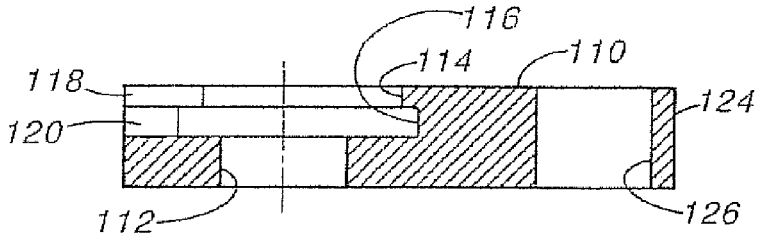
FIG. 19 is a side cross section of the stripper retainer of FIG. 18.

The third version of the new one-piece stripper retainer 110 is substantially oblong as shown in FIGS. 18 and 19. The third version 110 as above includes a bore hole 112, a counter-bore 114 and an undercut 116. The counter-bore 114 and undercut 116 are both slotted at 118 and 120 respectively, with the counter-bore slot 118 having a neck at 122 to provide the snap-in feature for the stripper cup 40 as explained above.

The third version 110 has an extended portion 124 with an oblong hole 126 spaced from the bore hole 112. It is appreciated that FIGS. 18 and 19 show a first end and a second end, for example the first end being proximate to the bore hole 112 and the second end proximate to the oblong hole 126. The stripper retainer 110 is directed to use with the punch retainer 14 as shown in FIGS. 1 and 2. As above, the stripper cup 40 and flange 42 are snapped into the counter-bore 114 and undercut 116 and the stripper cup 40 is positioned over the punch which has been previously inserted in the punch retaining hole 18. The screw 44 passes through the oblong hole 126 and is threaded into hole 20 to positively hold down the stripper retainer 110 and stripper cup 40 to the punch retainer 14. In addition, it is appreciated that FIG. 19 teaches the stripper retainer 110, including the extended portion 124, is a generally planar member with the bore hole 112, counter-bore 114 and undercut 116 therewithin.

The invention claimed is:

1. In combination, a stripper cup, a stripper retainer, and a punch for use with a punch retainer, the combination comprising:

the punch;

the stripper cup, the stripper cup having an outer diameter and a flange extending outwardly from the outer diameter;

the stripper retainer, the stripper retainer comprising:

a generally planar member having a bore hole, a counter-bore and an undercut, the bore hole extending through the generally planar member, the counter-bore and the undercut being generally concentric with the bore hole;

the counter-bore having a diameter generally equal to the outside diameter of the stripper cup and the undercut having a diameter greater than the outer diameter of the stripper cup to accommodate the flange;

a first slot extending from the counter-bore to an exterior of the generally planar member, the first slot having a neck with an opening less than the diameter of the counter-bore and less than the outer diameter of the stripper cup; and a second slot extending from the undercut to the exterior of the generally planar member;

the stripper cup being snapped into the first slot and held by the generally planar member of the stripper retainer, the punch being disposed in the stripper cup and the stripper retainer and extending through the bore hole.

2. The combination of claim 1, wherein the generally planar member has an extended portion that is generally coplanar therewith.

3. The combination of claim 2, further comprising:

a third slot extending from the bore hole to an exterior of the extended portion so as to divide the extended portion into first and second sections, the slot being generally perpendicular to a plane containing the generally planar member; and a fastener extending between the first and second sections such that the fastener is operable to urge the sections into closer proximity, thereby reducing a diameter of the bore hole to grip the punch extending therethrough.

4. The combination of claim 3, further comprising a threaded hole in the extended portion extending perpendicularly through the third slot, the fastener being a screw disposed in the threaded hole and operable to tighten and loosen the bore hole of the generally planar member about the punch.

5. The combination of claim 3, wherein the third slot extends generally perpendicular to the first slot.

6. The combination of claim 3, wherein the third slot extends generally parallel to the first slot.

7. The combination of claim 2, wherein the extended portion has an oblong hole spaced apart from the bore hole, the oblong hole extending through the extended portion, whereby a screw extending through the oblong hole can attach the generally planar member to the punch retainer.

8. The combination of claim 1, further comprising an anti-rotation heel extending from the generally planar member to snuggly fit a nose of the punch.

* * * * *